US009335066B2

(12) United States Patent
Humphrey et al.

(10) Patent No.: US 9,335,066 B2
(45) Date of Patent: May 10, 2016

(54) WATER HEATING SYSTEM

(71) Applicant: RINNAI AMERICA CORPORATION, Peachtree City, GA (US)

(72) Inventors: Scott Gilman Humphrey, Powder Springs, GA (US); Timothy J. Shellenberger, Tyrone, GA (US); James Stuart York, Sharpsburg, GA (US)

(73) Assignee: Rinnai America Corporation, Peachtree City, GA (US)

( * ) Notice: Subject to any disclaimer, the term of this patent is extended or adjusted under 35 U.S.C. 154(b) by 583 days.

(21) Appl. No.: 13/749,058

(22) Filed: Jan. 24, 2013

(65) Prior Publication Data

US 2013/0152876 A1 Jun. 20, 2013

Related U.S. Application Data

(63) Continuation of application No. 11/715,084, filed on Mar. 5, 2007, now abandoned.

(51) Int. Cl.

| | |
|---|---|
| ***F24H 1/18*** | (2006.01) |
| ***F24H 9/12*** | (2006.01) |
| ***F24H 1/12*** | (2006.01) |
| ***F24H 9/20*** | (2006.01) |
| ***F24H 1/14*** | (2006.01) |
| *F24H 1/24* | (2006.01) |

(52) U.S. Cl.

CPC ..... *F24H 9/2035* (2013.01); *F24H 1/125* (2013.01); *F24H 1/145* (2013.01); *F24H 1/186* (2013.01); *F24H 9/124* (2013.01)

(58) Field of Classification Search

CPC ..... F24H 9/2035; F24H 9/124; F24H 9/0005; F24H 1/125; F24H 1/186; F24H 1/145; F24H 1/18; F24H 7/005; F24D 17/0026

USPC ..... 122/40, 44.1, 41, 14.3, 14.31, 14.22; 237/19, 16, 62

IPC ..... F24H 1/18, 1/12, 1/24, 9/12

See application file for complete search history.

(56) References Cited

U.S. PATENT DOCUMENTS 337,524 A * 3/1886 Schreiber ..... F01K 21/04 122/40

735,321 A 8/1903 Walker (Continued)

FOREIGN PATENT DOCUMENTS

| | | | |
|---|---|---|---|
| EP | 0295967 A2 * | 12/1988 | ..... F24H 1/205 |
| GB | 2169692 | 7/1986 | |
| JP | 57-161444 | 10/1982 | |

*Primary Examiner* — Gregory Huson
*Assistant Examiner* — Daniel E Namay
(74) *Attorney, Agent, or Firm* — Altera Law Group, LLC

(57) ABSTRACT

A water heating system including a water container having a cold water inlet that connects to a water supply, a hot water outlet, a water heater outlet and a water heater inlet; an instantaneous water heater mounted to the water container and having a tank supply inlet connected to the water heater outlet, a tank supply outlet connected to the water heater inlet, a burner, and a heat exchanger located adjacent the burner between the tank supply inlet and the tank supply outlet; a pump connected between the water container and the instantaneous water heater that moves water between the water container and the instantaneous water heater; and a controller that operates the pump and the burner.

18 Claims, 13 Drawing Sheets

(56) References Cited

U.S. PATENT DOCUMENTS

| | | | | | |
|---|---|---|---|---|---|
| 817,589 | A | | 4/1906 | Roberts | |
| 1,555,338 | A | | 9/1925 | Vaughan | |
| 2,814,279 | A | * | 11/1957 | Thomas | F24D 17/00 122/14.22 |
| 2,823,649 | A | * | 2/1958 | Flynn | F24H 1/205 122/14.22 |
| 2,889,444 | A | | 6/1959 | Stiebel | |
| 3,249,303 | A | | 5/1966 | Townsend | |
| 3,670,807 | A | | 6/1972 | Muller | |
| 3,828,847 | A | | 8/1974 | Stein | |
| 4,178,907 | A | | 12/1979 | Sweat | |
| 4,210,102 | A | | 7/1980 | Dosmann | |
| 4,257,397 | A | | 3/1981 | Gouyou-Beauchamps | |
| 4,350,144 | A | | 9/1982 | Beckwith | |
| 4,473,351 | A | | 9/1984 | Hill | |
| 4,564,003 | A | | 1/1986 | Iwanicki et al. | |
| 4,638,944 | A | | 1/1987 | Kujawa et al. | |
| 5,020,721 | A | | 6/1991 | Horne | |
| 5,056,712 | A | | 10/1991 | Enck | |
| 5,193,138 | A | * | 3/1993 | Richey | F24D 11/002 165/104.19 |
| 5,203,500 | A | | 4/1993 | Horne, Sr. | |
| 5,233,970 | A | | 8/1993 | Harris | |
| 5,596,953 | A | * | 1/1997 | Hong | F24H 1/48 122/114 |
| 6,032,868 | A | | 3/2000 | DiMarco | |
| 6,131,536 | A | | 10/2000 | Kujawa | |
| 6,167,845 | B1 | | 1/2001 | Decker, Sr. | |
| 6,390,029 | B2 | | 5/2002 | Alphs | |
| RE37,745 | E | | 6/2002 | Brandt et al. | |
| 6,628,894 | B2 | | 9/2003 | Winter et al. | |
| 6,640,047 | B2 | | 10/2003 | Murahashi et al. | |
| 6,739,517 | B1 | | 5/2004 | Krueger | |
| 6,761,135 | B1 | | 7/2004 | Becktold | |
| 6,928,236 | B2 | | 8/2005 | Suzuki et al. | |
| 6,945,197 | B2 | | 9/2005 | Ryoo | |
| 7,322,532 | B2 | | 1/2008 | Takada et al. | |
| 7,460,769 | B2 | | 12/2008 | Ryks | |
| 2002/0146241 | A1 | | 10/2002 | Murahashi et al. | |
| 2003/0113107 | A1 | | 6/2003 | Winter et al. | |
| 2005/0074231 | A1 | | 4/2005 | Suzuki et al. | |
| 2007/0257123 | A1 | * | 11/2007 | Kobayashi | F24H 9/2035 237/19 |
| 2008/0197205 | A1 | | 8/2008 | Ene et al. | |
| 2011/0239673 | A1 | * | 10/2011 | Junge | F28D 20/02 62/238.7 |

* cited by examiner

WATER HEATING SYSTEM

TECHNICAL FIELD

This disclosure relates to a water heating system that has both residential and commercial applications.

BACKGROUND

It has long been a goal in the water heater industry to continue to improve so-called "first hour ratings." The first hour rating is an approximation of the usable hot water that a water heater can supply within an hour that begins with the water heater being fully heated. Beyond first hour ratings, it has also been desired to obtain a substantially continuous supply of hot water. Increasing the first hour rating, establishing substantially continuous hot water and at the same time decreasing overall energy usage is desirable.

SUMMARY

This disclosure relates to water heating systems including a water container having a cold water inlet that connects to a water supply, a hot water outlet, a water heater outlet and a water heater inlet, an instantaneous water heater mounted to the water container and having a tank supply inlet connected to the water heater outlet, a tank supply outlet connected to the water heater inlet, a burner, and a heat exchanger located adjacent the burner between the tank supply inlet and the tank supply outlet, a pump connected between the water container and the instantaneous water heater that moves water between the water container and the instantaneous water heater, and a controller that operates the pump and the burner.

This disclosure also relates methods of heating water with a water heating system, including causing hot water to flow outwardly of the water container through the hot water outlet, sensing temperature of water in the water container, engaging the pump and igniting the burner.

This disclosure further relates methods of substantially maintaining a selected temperature of water in the water container of the water heating system, including sensing temperature of the water in the water container, comparing a sensed water temperature to a selected water set temperature, engaging the pump if the sensed water temperature is less than the selected water set temperature and igniting the burner.

This disclosure also further relates methods of preventing water in the water heating system from freezing including sensing temperature of water proximate to or in the heat exchanger, comparing the sensed water temperature to a first selected water temperature, and comparing the sensed water temperature to a second selected water temperature if the sensed water temperature is less than the first selected water temperature: engaging the pump if the sensed water temperature is greater than the second selected water temperature, sensing temperature of water in the water container, comparing the water container sensed temperature to a third selected water temperature and disengaging the pump if the water container sensed temperature is greater than the third selected water temperature, or engaging the pump if the sensed water temperature is less than the second selected water temperature, sensing temperature of water proximate to or in the heat exchanger, comparing sensed heat exchanger water temperature to the third selected water temperature and disengaging the pump in the sensed heater exchanger water temperature is greater than the third selected water temperature.

This disclosure also further relates to a water heater system comprising: a burner unit adapted to heat water; a water container associated with the burner unit and having a cold water inlet and a hot water outlet; and a controller that operates the burner to maintain the temperature of water in the water container above about 100° F. when at least about 2.5 gpm of heated water is substantially continuously removed from the water container for at least about 15 minutes.

DETAILED DESCRIPTION

Figure 1:
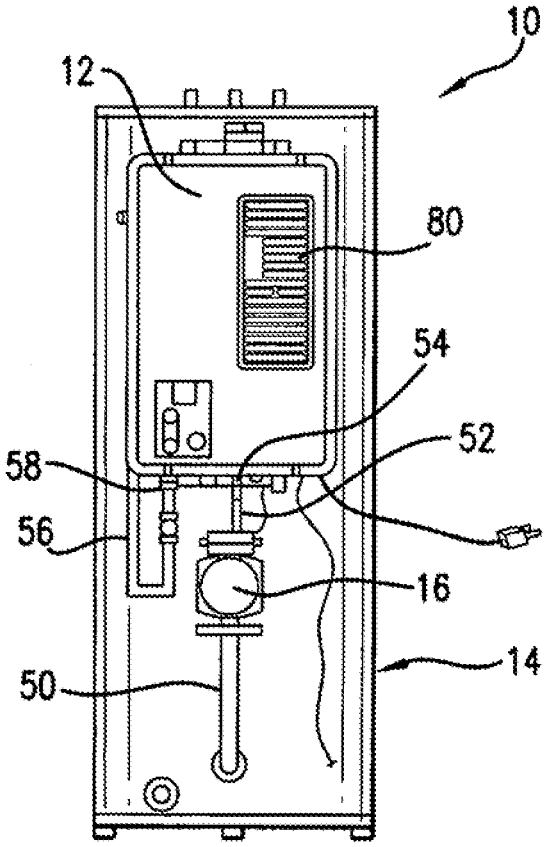
FIG. 1 is a schematic front elevational view of a water heating system.

It will be appreciated that the following description is intended to refer to specific examples of structure selected for illustration in the drawings and is not intended to define or limit the disclosure, other than in the appended claims.

Turning now to the drawings in general and FIGS. 1-4 in particular, water heating system 10 includes an instantaneous water heater 12 mounted onto a water container 14. A pump 16 is positioned to supply water from water container 14 to instantaneous water heater 12.

Water container 14 comprises a water tank 18, a layer of insulation 20 substantially surrounding water tank 18 and a jacket 22 substantially surrounding insulation 20. Tank 18 may be made from any number of possible materials and can be formed in any number of shapes, all well known in the art. Similarly, insulation 20 may be formed of any number of materials known in the art such as urethane foam, for example. The foam may completely surround the water tank 18 or may have certain portions cut away to allow for water inlets, outlets, temperature sensors and the like. Jacket 22 may also be made from any number of materials known in the art and is typically made out of a thin steel sheet, for example. Water tank 18 has a cold water inlet 24 which connects to a dip tube 26. The dip tube is typically open at the distal end 28, near the bottom of water tank 18. Dip tube 26 may include any number of openings 30 of various sizes and shapes at various locations along its length, as desired and may be made in various shapes and from materials well known in the art.

Water tank 18 also has a hot water outlet 32. An anode 34 is typically connected to hot water outlet 32 and is suspended within water tank 18.

Water tank 18 may also include a temperature and pressure relief valve 36 as desired. This can be located in any number of locations on water tank 18. Also, a drain 38 may be located near the bottom of water tank 18. It is also possible for water tank 18 to contain additional "side spuds" that may be used for connection to an alternate appliance such as a forced air heating device, a hot water circulatory heating device and the like.

Figure 2:
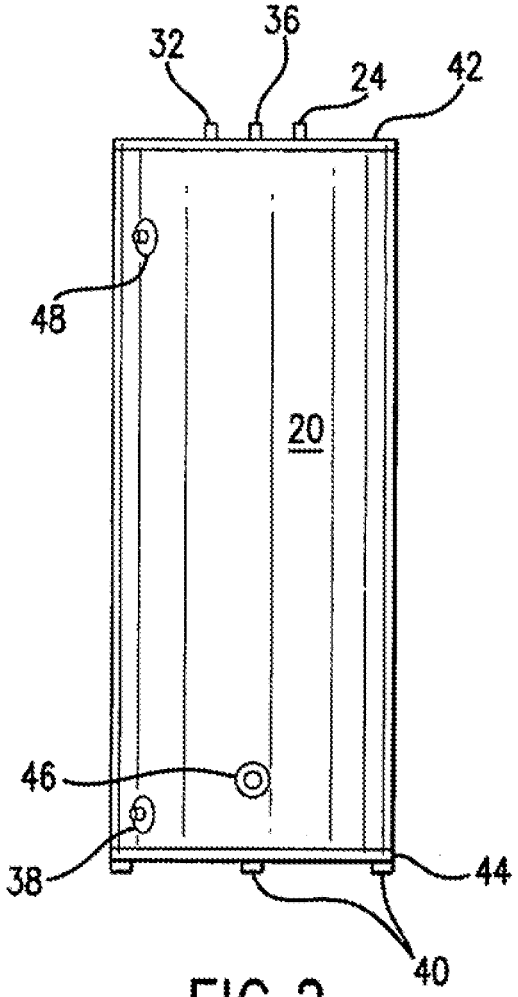
FIG. 2 is a schematic front elevational view of the water heating system of FIG. 1 with the instantaneous water heater removed.
Figure 3:
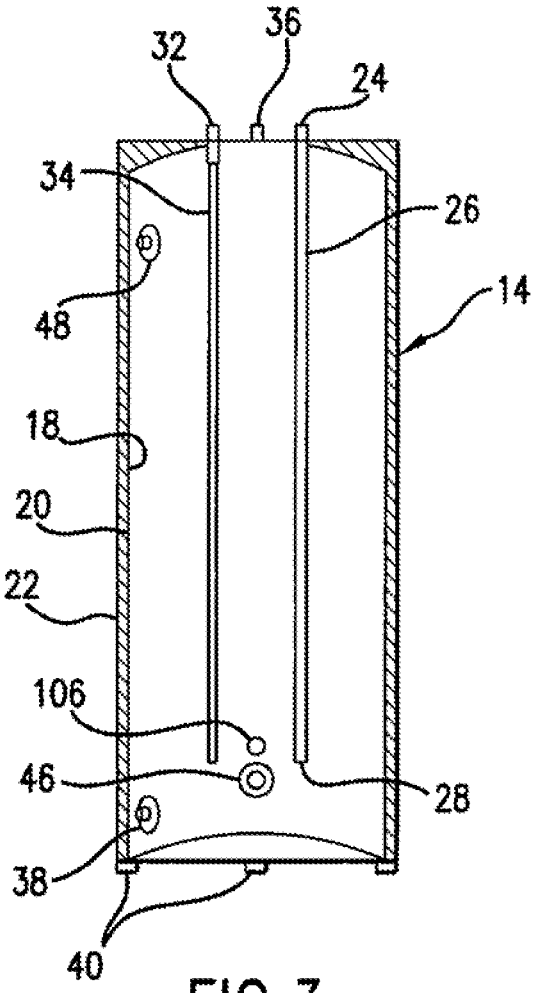
FIG. 3 is a schematic cross-sectional view of the water container shown in FIG. 2.
Figure 4:
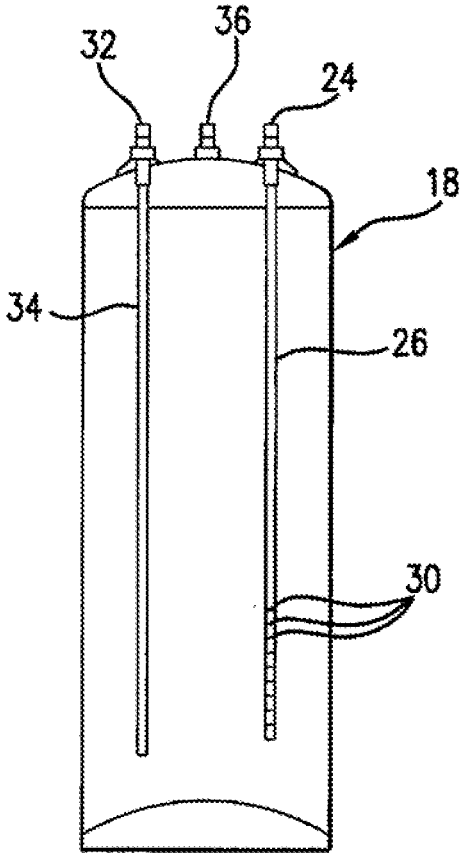
FIG. 4 is a schematic partial sectional view of a water tank.

Water container 14 preferably rests on a plurality of feet 40 as particularly shown in FIG. 2. Jacket 20 is capped on its upper end by a top pan 42 and capped on its lower end by a bottom pan 44.

Also shown in FIG. 2 is a water heater outlet 46 and a water heater inlet 48. The water heater outlet 46 connects to a supply line 50 which connects to pump 16. A supply line 52 as shown in FIG. 1 connects between pump 16 and tank supply inlet 54 of instantaneous water heater 12. Similarly, a supply line 56 connects between water heater inlet 48 and tank supply outlet 58. The supply lines 50, 52 and 56 may be made from materials known in the art and may be shaped as shown or in any workable configuration, length or diameter.

Figure 5:
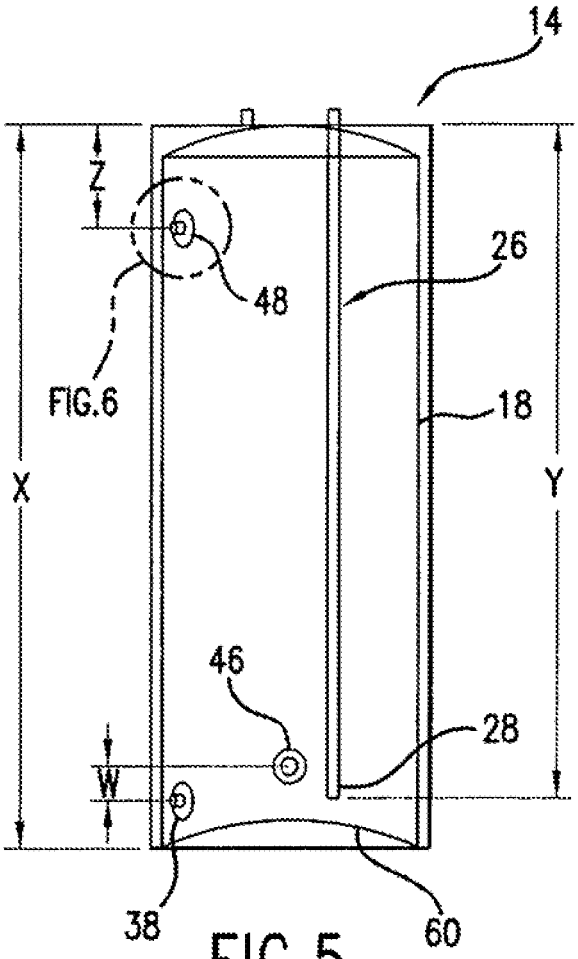
FIG. 5 is a schematic partial sectional view of the tank of FIG. 4 with various dimensions.
Figure 6:
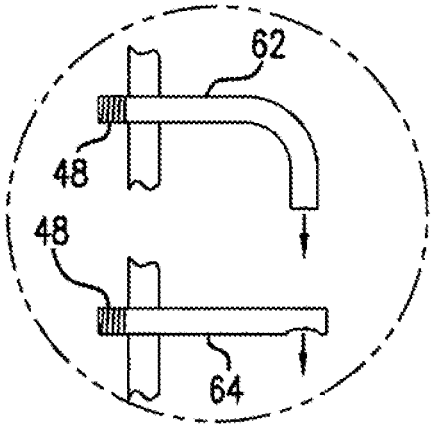
FIG. 6 is an exploded top view of two water heater inlets.

Referring now to FIGS. 5 and 6, it can be seen that water container 14 has a dimension X. The dip tube 26 has a length that is substantially shown by arrows Y. Length Y is less than length X such that the distal end 28 of dip tube 26 extends almost down to the bottom 60 of tank 18 such that cold water enters at a lower portion of water tank 18. It can also be seen that the distal end 28 of dip tube 26 is lower than water heater outlet 46. That orientation allows for introduction of cold water through dip tube 26 to a lower portion of water tank 18 such that the colder water in water tank 18 is relatively close to water heater outlet 46 whereby relatively colder water is pumped into instantaneous water heater 12 when instantaneous water heater 12 is actuated. Drain 38 is separated from water heater outlet 46 by a distance W. Drain 38 is about the same vertical height from the bottom of tank 60 as the distal end 28 of dip tube 26.

On the other hand, water heater inlet 48 is located at an upper portion of water tank 18. This allows for hot water produced by instantaneous water heater 12 to enter an upper portion of water tank 18. It should be noted that the term "upper portion" of water tank 18 refers to about the top half of water tank 18 while the term "lower portion" of water tank 18 refers to about the lower half of water tank 18. Nonetheless, it is desired to have water heater inlet 48 located at a distance Z from the top of water tank 18, that is, approximately in the upper quartile of the upper portion of water tank 18. Similarly, it is preferred to have the water heater outlet 46 in the lower quartile of the lower portion of water tank 18.

FIG. 6 shows alternate structures from introducing heated water through water heater inlet 48. The upper alternative is a tube 62 that enters water tank 18 horizontally and toward the center of water tank 18. It then curves sideways by about 90° such that heated water is directed in a horizontal "swirling" motion around water tank 18. This tends to promote circulation of the relatively hotter water in the upper portion of water tank 18. Alternatively, the lower portion of FIG. 6 shows a tube 64 that extends horizontally into water tank 18 toward the center of water tank 18. It has an opening that is also oriented horizontally. This provides some "swirling" motion of heated water into water tank 18, but it is not intended to be as effective in the degree of movement of the heated water. Alternate constructions and alternate directional flows are possible, depending on the selected parameters, heat inputs, and the like of the water heating system.

Figure 7:
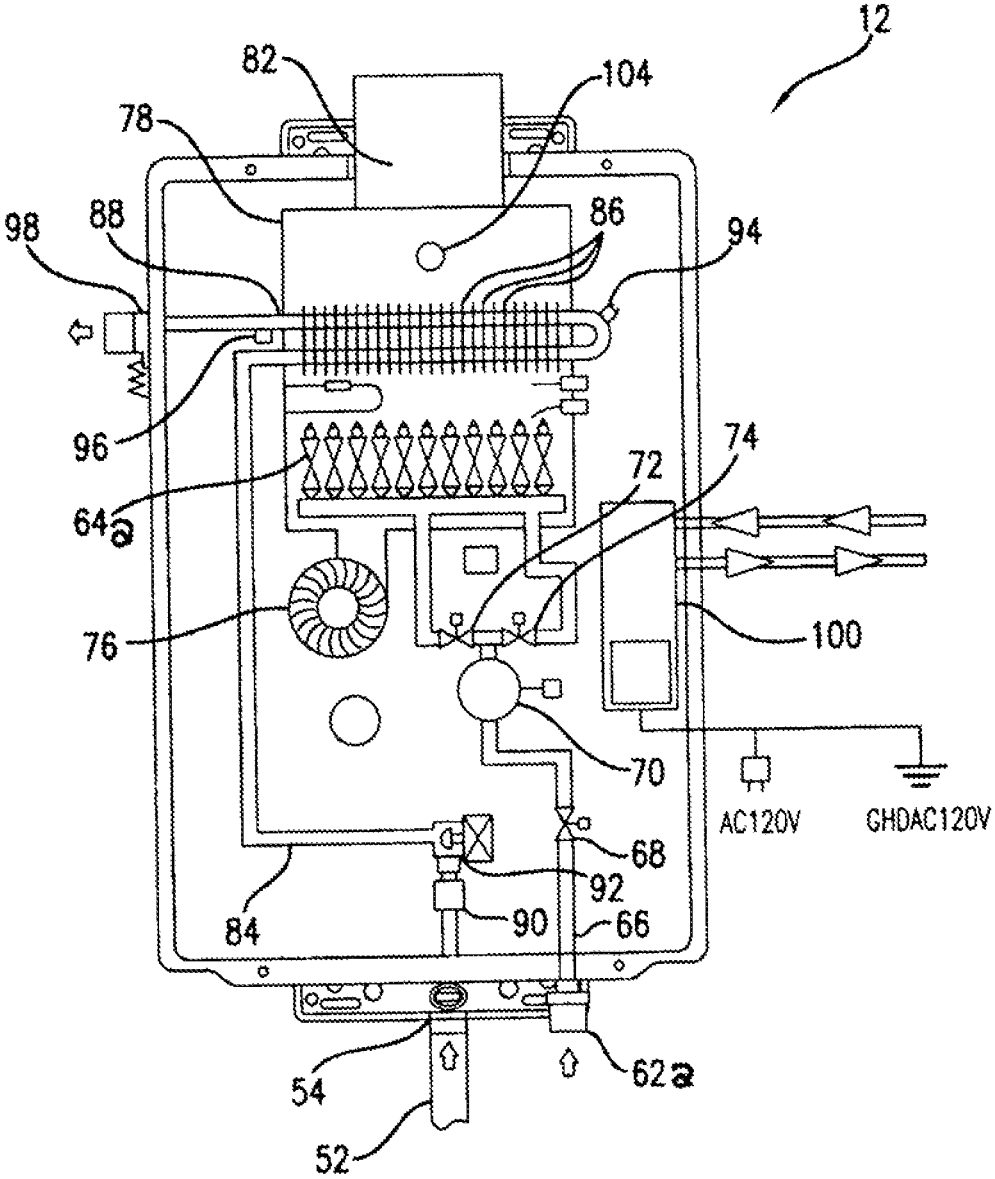
FIG. 7 is a schematic front elevational view of the instantaneous water heater of FIG. 1 with the front cover removed.

Referring now to FIG. 7, an instantaneous water heater 12 is shown. Instantaneous water heater 12 includes a gas inlet **62*a* that connects to a gas supply (not shown) on one end and to a burner 64*a* by way of a gas supply conduit 66 which includes a solenoid valve 68, modulating solenoid valve 70 and a pair of solenoid valves 72 and 74 that all distribute fuel to burner 64*a*. A combustion fan 76 connects to a burner enclosure 78 that draws ambient air through a grate 80 (shown in FIG. 1) and introduces that ambient air into burner chamber 78. A flue 82 connects to burner chamber 78. Flue 82** is connected to some type of vent apparatus (not shown) that is known in the art.

Separately, conduit 52 connects to tank supply inlet 54. A water supply line 84 connects to tank supply inlet 54 and passes through burner 78. Water supply is fitted with a multiplicity of heat exchange fins 86 to form heat exchanger 88.

A water flow sensor 90 is located downstream of tank supply inlet 54. Water flow sensor 90 is followed by a water flow control device 92 to maintain outlet water temperature. Water conduit 84 also includes a overheat switch 94. A hot water thermistor 96 connects to water supply line 84 downstream of burner 70. Water supply line 84 also connects to tank supply outlet 98 as it exits instantaneous water heater 12. Tank supply outlet 98 also connects to supply line 56. Tank supply outlet 98 (of FIG. 7) is an alternative to tank supply line 58 of FIG. 1 which exits instantaneous water heater 12 from the bottom. Supply line 56 can be configured for connection to tank supply 98 or 58 as appropriate.

Figure 8:
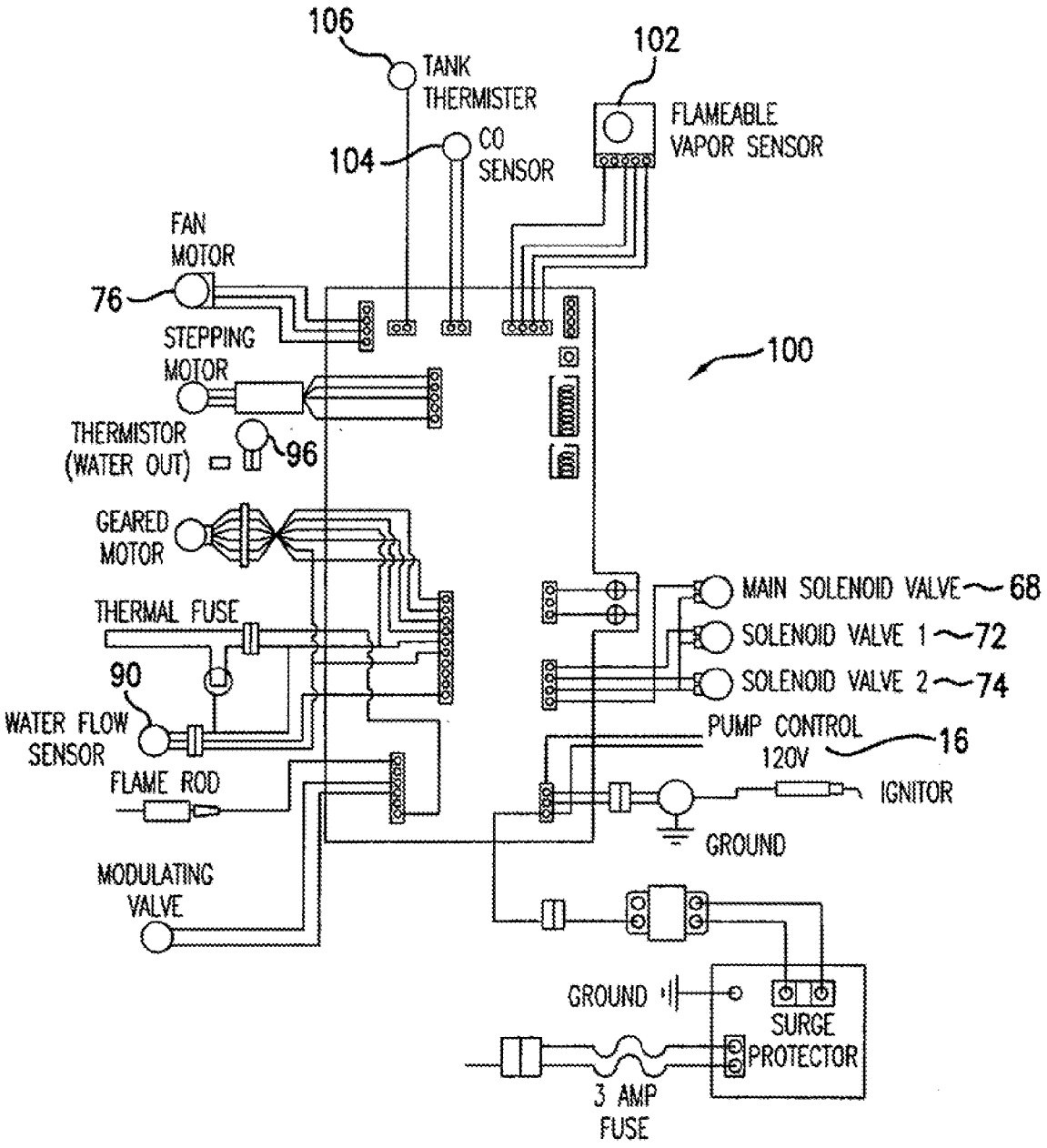
FIG. 8 is a schematic wire diagram of the water heating system.

A controller 100 is also located within instantaneous water heater 12 and is described below in reference to FIGS. 7 and 8. FIG. 8 shows the fan 76, the thermistor 96, water flow sensor 90, flammable vapor sensor 102, solenoid valves 68, 72 and 74.

There is also a CO sensor 104 that is placed within burner chamber 78. The controller connects to tank thermistor 106, which connects between the water tank 18 and controller 100. There is also a connection between controller 100 and pump 16. There are further additional electrical connections and functions in controller 100 that are well known to those skilled in the art and need not be further discussed.

Figure 9:
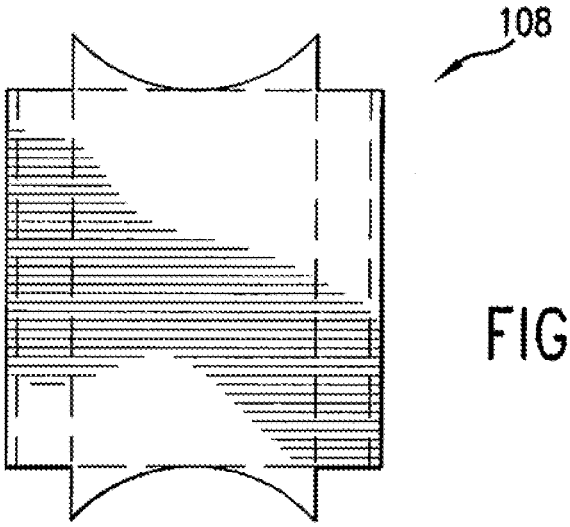
FIG. 9 is a top plan view of a sheet of material used to form a mounting bracket that may be used in accordance with the water heating system.
Figure 10:
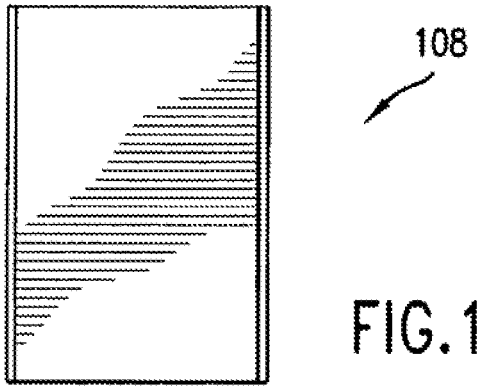
FIG. 10 is a rear elevational view of the sheet of material shown in FIG. 9 after forming.
Figure 11:
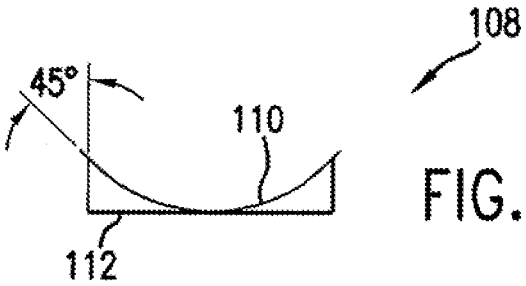
FIG. 11 is a top plan view of a mounting bracket that may be used in accordance with the water heating system.

FIGS. 9-11 show a mounting bracket 108 that is used to mount instantaneous water heater 12 to water container 14. It can be seen that there is a curved surface 110 that is sized and shaped to substantially match the circumference of at least a portion of jacket 20. Similarly, there is an opposed surface 112 that is sized and shaped to substantially match at least a portion of one side of instantaneous water heater 12. The surface 10 is preferably directly connected to jacket 14 on the one hand and, on the other hand, the instantaneous water heater 12 is directly connected to surface 112. In this way, instantaneous water heater 112 is mounted onto at least a side portion of water container 14.

The mounting bracket 108 can be formed in any number of shapes and sizes, so long as they reliably and, most preferably, substantially permanently mount instantaneous water heater 12 to water container 14. The particular size, shape and material of mounting bracket 108 is not overly important. Any number of materials may be used so long as they provide the appropriate strength and longevity to keep instantaneous water heater 12 mounted in the selected position with respect to water container 14.

Figure 12:
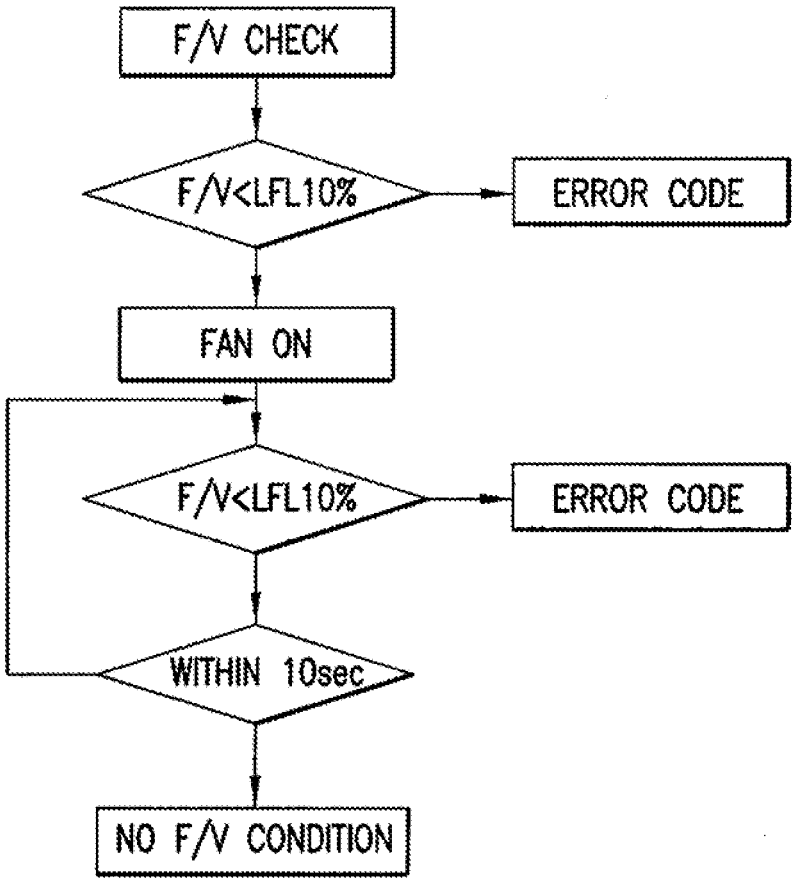
FIG. 12 is a logic diagram of one manner in executing a flammable vapors sequence.

Selected portions of the operation of water heating system 10 will now be described. With particular reference to FIG. 12, a flammable vapors sequence is disclosed. In that case, there is a step in which flammable vapor sensor 102 detects the concentration of flammable vapors and, if the level of flammable vapors exceeds a selected concentration such as about 10% (LFL), the controller 100 automatically generates an error code. This can shut down the system for a selected period of time or until the controller 100 is reset. In the event that the concentration is below the selected concentration, combustion fan 76 is engaged for a selected period of time, such as for about 10-about 20 seconds. Then, flammable vapor sensor 102 takes another sensor reading of the concentration of flammable vapors. If the second sensed concentration flammable vapors exceeds the selected concentration, the controller 100 automatically generates an error code and shuts down the system. This second measurement is taken within a selected period of time such as within about 10 seconds of the activation of combustion fan 76. Then, after the selected time, controller 100 determines that there is no flammable vapors condition. This allows for initiation of the pump cycle described below. It should be noted that, although the selected flammable vapors concentration has been described as being about 10%, lower or higher concentrations can be selected. Also, the length of time of sensing, the length of time of operation of combustion fan 76 and the number of repetitions of the process prior to a determination by the controller that there is a no flammable vapors condition can be varied by those skilled in the art.

Figure 13:
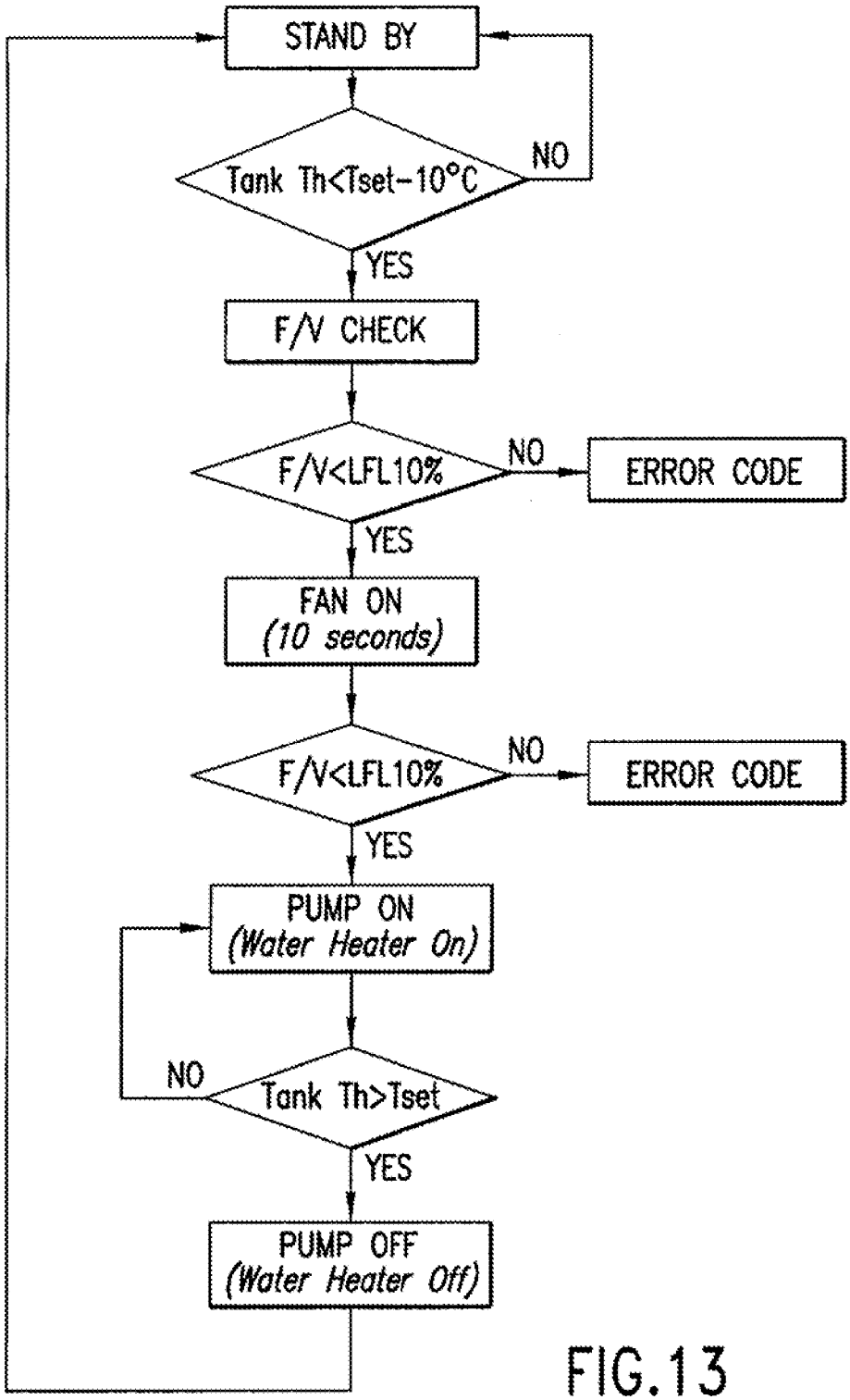
FIG. 13 is a logic diagram of one way of executing a pump sequence.

FIG. 13 shows a logic diagram of one way in which a pump sequence can be executed. In that case, the system and controller 100 are in a so-called "standby" mode. At that point, thermistor 106 senses the temperature of water in water tank 18. This sensing can be either a direct sensing of the water by the thermistor or by an indirect method, wherein, for example, thermistor 106 is mounted directly to the side of water tank 18 or by some other means known in the art. It is also possible to place thermistor 106 at any position along supply line 50. Sensing the water temperature within water tank 18 or supply line 50 can be accomplished by any number of sensors other than thermistors, those sensors being known in the art.

The sensed water temperature within water tank 18 is compared to a selected set temperature. If the sensed temperature is greater than the set temperature, the controller 100 returns to the standby mode. If the sensed temperature is less than the selected temperature, the controller 100 proceeds to a flammable vapors check such as described with respect to FIG. 12 and as shown in FIG. 13. Once the level of flammable vapors has been determined to be low enough to satisfy the "no flammable vapors condition," pump 16 is activated by controller 100 to cause the flow of water outwardly from water tank 18 and into instantaneous water heater 12. This permits the potential initiation of a burn cycle which is permitted upon confirmation by controller 100 that pump 16 has been activated.

Activation of the pump, as noted above, induces water to flow from water tank 18 and into supply line 50. Pump 16 also causes water to flow through supply line 52 and into instantaneous water heater 12. Depending upon activation of burner 78, water flows through water supply line 84 and outwardly of instantaneous water heater through tank supply outlet 98 (see FIG. 7) or tank supply outlet 58 (see FIG. 1). Water then flows through supply line 56 and into water tank 18 through water heater inlet 48. The water circulated through instantaneous water heater 12 can be heated water if the burner 78 has been activated, but may otherwise non-heated if burner 78 is otherwise deactivated. Hence, pump 16 is connected between water container 14 and instantaneous water heater 12 and moves water between the water container 14 and the instantaneous water heater 12 and the controller 100 operates pump 16 and burner 78. Controller 100 can operate pump 16 and burner 17 in the conventional way such as by a wire connection. However, other means of operating the pump and burner are possible such as through wireless communication, indirect communication through another communication port or even fiber optics. The burner cycle may include a varying degree of heat generation whose output is adjusted by controller 100 in response to temperature of water entering instantaneous water heater 12. For example, upon initiation of a burner cycle, burner 78 may be controlled by controller 100 to supply heat at a rate of about 100,000 BTU/hr. This degree of heat generation may be supplied for a selected period of time or in response to the sensed temperature of water, at which point controller 100 adjusts or varies the heat output to a lower level such as about 75,000 BTU/hr. This cycle of sensing and adjusting burner 78 can be continued so that yet another degree of heat generation such as about 44,000 BTU/hr may be generated. Those skilled in the art will appreciate that the above three examples are just that, namely examples. Any number of adjustment points along a continuum of about 30,000 BTU/hr to about 100,000 BTU/hr is possible.

Separately, thermistor 106 continues either continuously or periodically to sense the temperature of water in water tank 18. This process continues until the sensed temperature of the water in water tank 18 exceeds the selected set temperature. If the sensed water temperature is less than the set temperature, controller 100 continues to permit the pump cycle and burn cycle to continue. If the sensed water temperature in water tank 18 is greater than the selected set temperature, then controller 100 deactivates the pump 16 and/or burner 64*a*.

Figure 14:
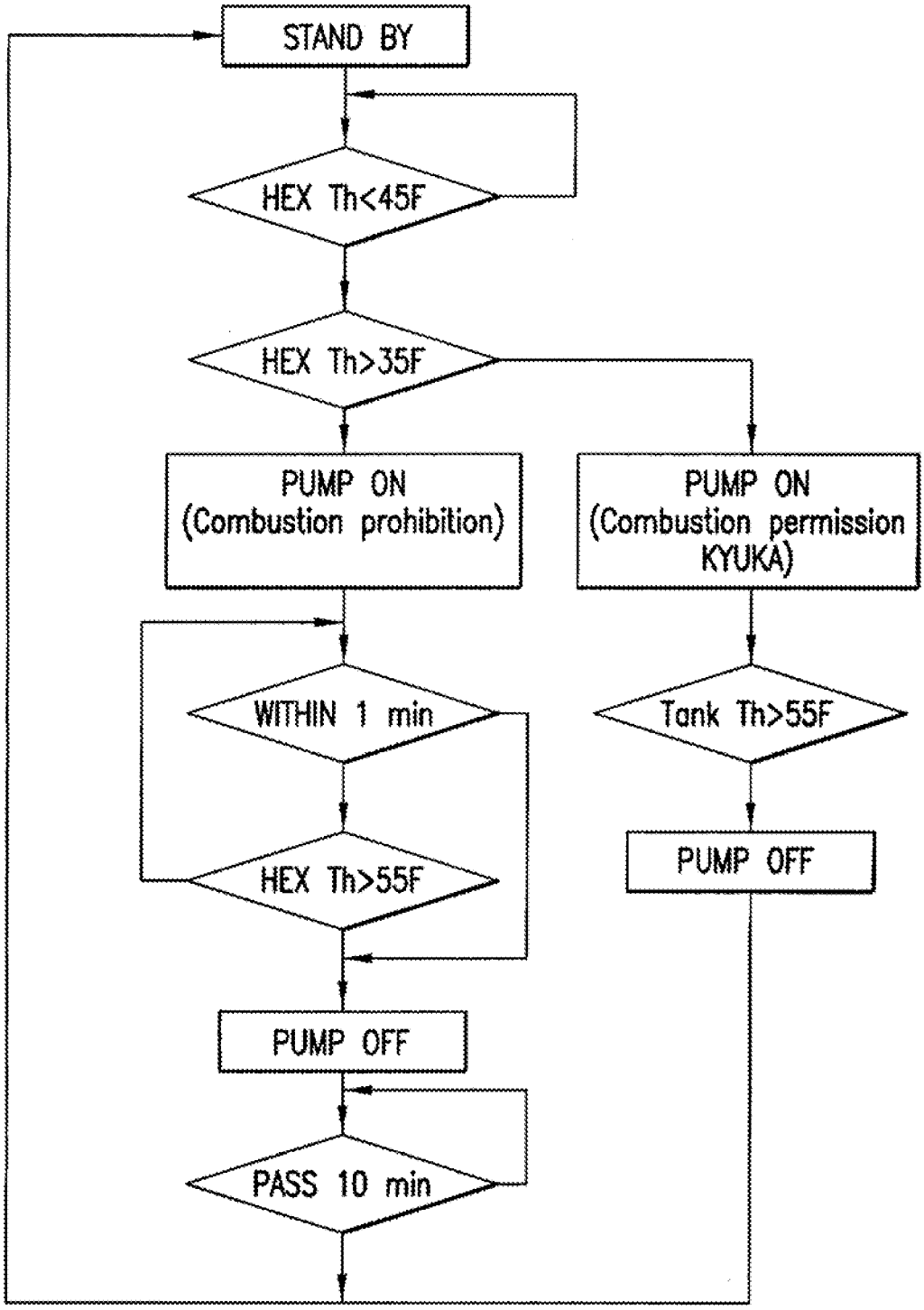
FIG. 14 is a logic diagram of one way of executing a freeze protection sequence.

Referring to FIG. 14, a freezing prevention cycle is described. In that case, the controller 100 is in standby mode. The thermistor 96 of instantaneous water heater 12 senses the temperature of the water proximate to heater exchanger 88. The sensed water temperature is compared to a selected temperature which may be, for example, 45.degree. F. If the sensed temperature in or proximate heat exchanger 88 is greater than the selected temperature, the controller remains in standby mode. If, however, the sensed water temperature is less than the selected temperature, the sensor then compares the sensed temperature to a second selected temperature that is less than the first selected temperature. One possibility is 35.degree. F. If the sensed water temperature is greater than the second selected temperature (35.degree. in this example), then controller 100 activates the pump and can further activate burner 64*a*. Those sequences are permitted until the continued or periodically sensed water temperature in or proximate heat exchanger 88 reaches a third selected temperature, such as 55.degree. F. If the sensed temperature exceeds the third selected temperature, pump 16 and/or burner 64*a* may be deactivated.

On the other hand, if the sensed water temperature is less than the second selected temperature, the pump cycle may be initiated as previously described. The pump cycle is permitted to continue for a selected period of time, at which point the sensed temperature, either by continuous or periodic means, such as one minute, is compared to the third selected temperature. If the sensed temperature is greater than the third selected temperature, pump 16 is then deactivated. This cycle can be repeated any number of times with varying degrees of frequency and with varying selected temperatures.

Figure 15:
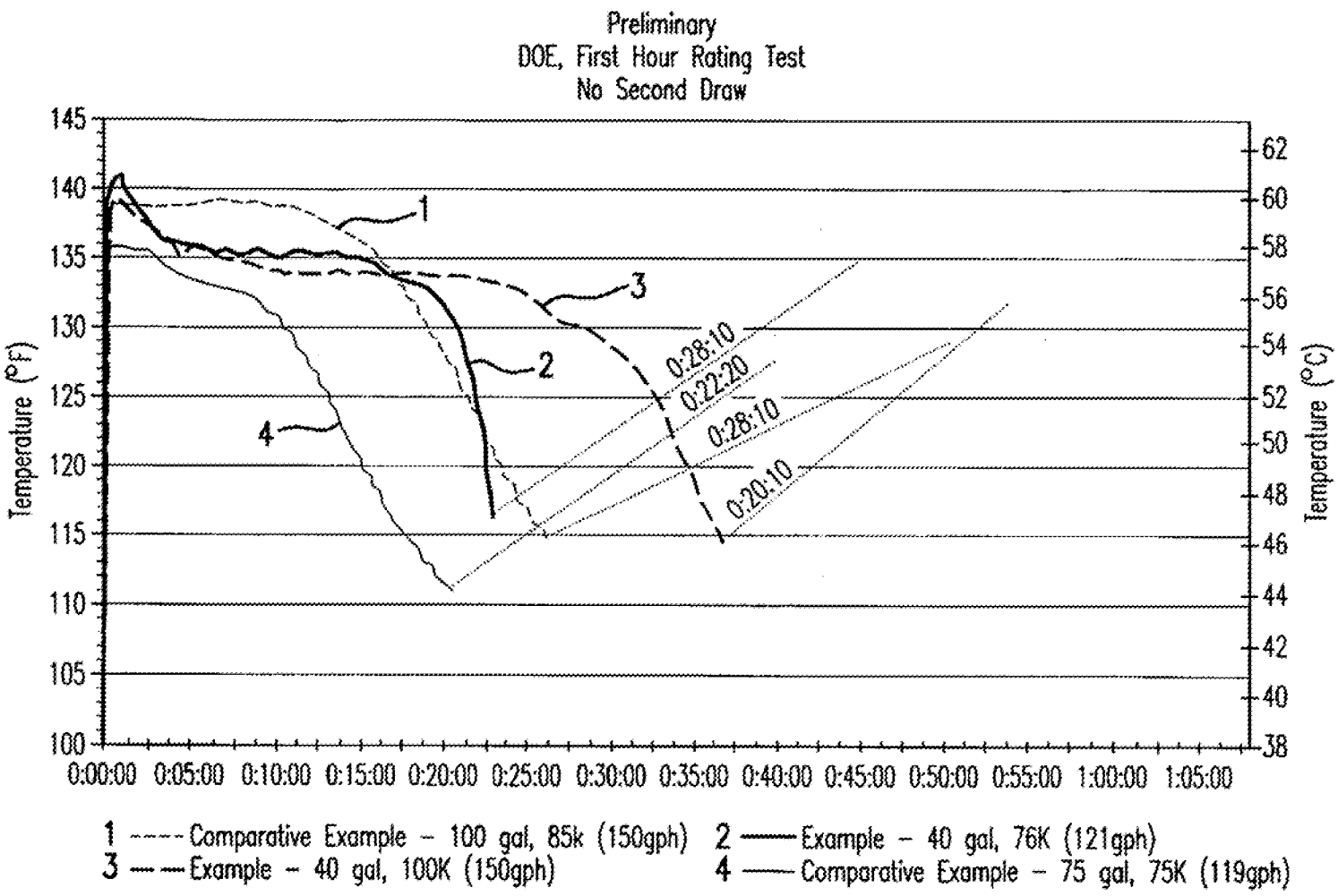
FIG. 15 is a graph of four comparative first hour rating tests.

FIG. 15 is a graph that shows a comparison between two water heating systems 10 such as that described above. The two systems 10 were made with 40-gallon tanks 18. One had a heat input of 76,000 BTU/hr and the other 100,000 BTU/hr. They were compared to a 100-gallon gas-fired conventional water heater with 85,000 BTU/hr input and a 75-gallon conventional water heater with a 75,000 BTU/hr input. Both water heating systems 10 and the conventional water heaters were set to 135° F. temperature and first hour ratings were determined in accordance with Department of Energy (DOE) test protocols.

Water heaters 2 and 3 are water heaters in accordance with water heating system 10. They each had a 40-gallon tank 18 and an instantaneous water heater 12. The instantaneous water heater had inputs of 76,000 and 100,000 BTU/hr, respectively. Conventional water heater 4 had a virtually identical heat input of 75,000 BTU/hr and a tank nearly twice the size of water heaters 2 and 3. It can be seen that water heater 2 maintained its heated temperature for a significantly longer period of time than conventional water heater 4 with the same heat input. Similarly, water heater 3, although having a slightly greater than 15% higher heat input than conventional water heater 1, had a tank volume of less than half, yet substantially maintained the set temperature for a significantly longer time than conventional water heater 1. Also, water heater 2, despite having a slightly smaller heat input than conventional water heater 1, was able to maintain at least substantially the same set temperatures as conventional water heater 1.

It can also be seen that conventional water heater 1 and water heater 3 had the same first hour rating of 150 gph, while water heater 2 and conventional water heater 4 had similar first hour ratings of 121 gph and 119 gph, respectively.

Figure 16:
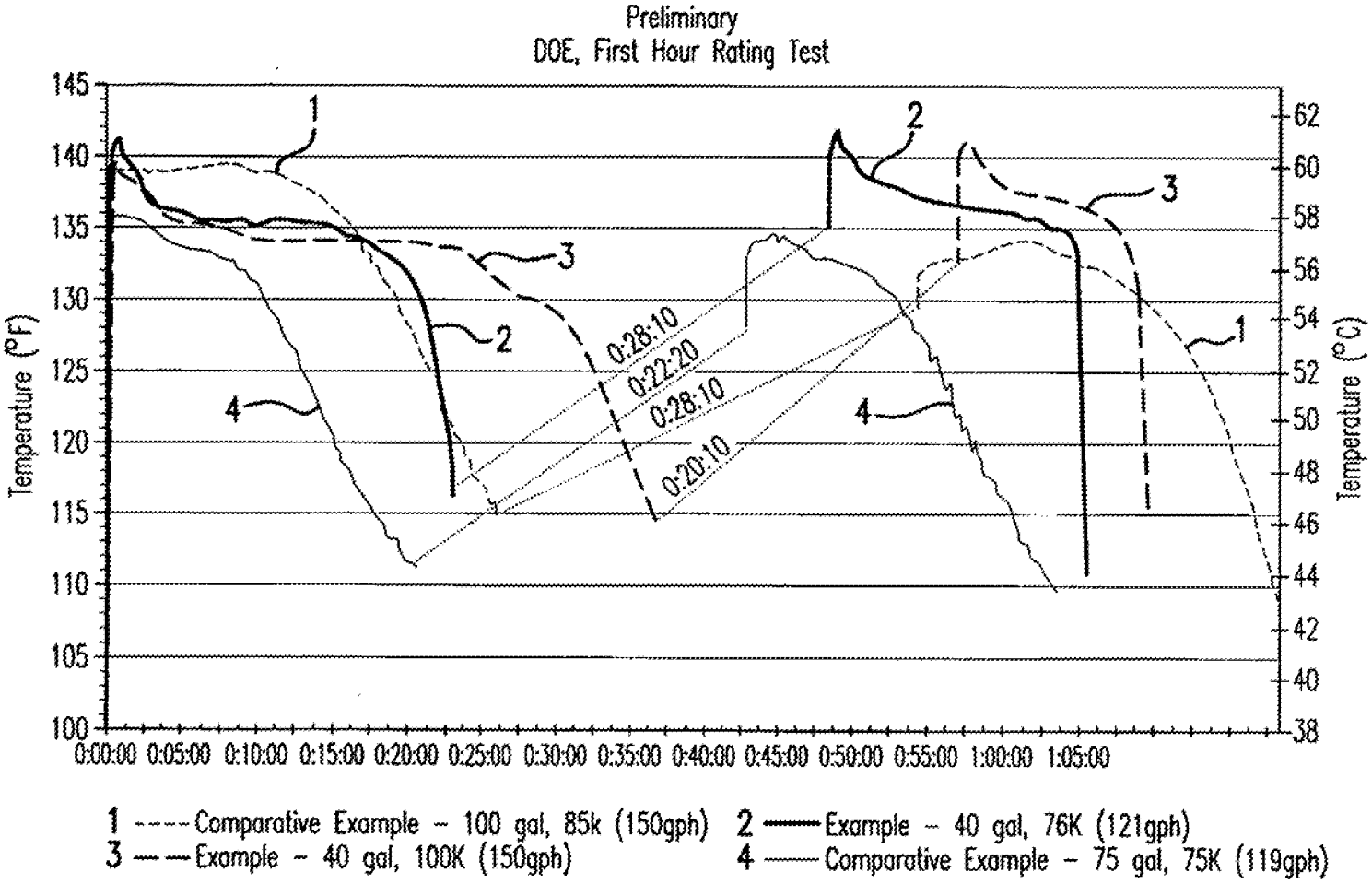
FIG. 16 is a graph of the four tests of FIG. 15, but extended to include recovery times.

FIG. 16 shows another comparative test wherein a test of the same conventional water heaters and water heating systems described above with respect to FIG. 15 were made. The left hand portion of FIG. 16 is the same as FIG. 15. However, all four water heaters were subjected to a recovery comparison. The recovery times are shown in the middle of FIG. 16. FIG. 16 compares recovery times of conventional water heater 1 and water heater 2 on the one hand and water heater 3 and conventional water heater 4 on the other hand. In the case of conventional water heater 1 and water heater 2, the recovery time was set for 28 minutes, 10 seconds. It can be seen that over that course of the set time, water heater 2 achieved a higher temperature by about 7° F. over conventional water heater 1.

Similarly, the comparison between water heater 3 and conventional water heater 4 was run for approximately the same time with the conventional water heater running for two minutes longer. Nonetheless, it was unable to reach the temperature that water heater 3 was able to reach, the difference being about 5° F. It should be noted that conventional water heater 4 was provided with more that an additional 10% time to account for the difference in heat input of water heater 3 over conventional water heater 4.

Figure 17:
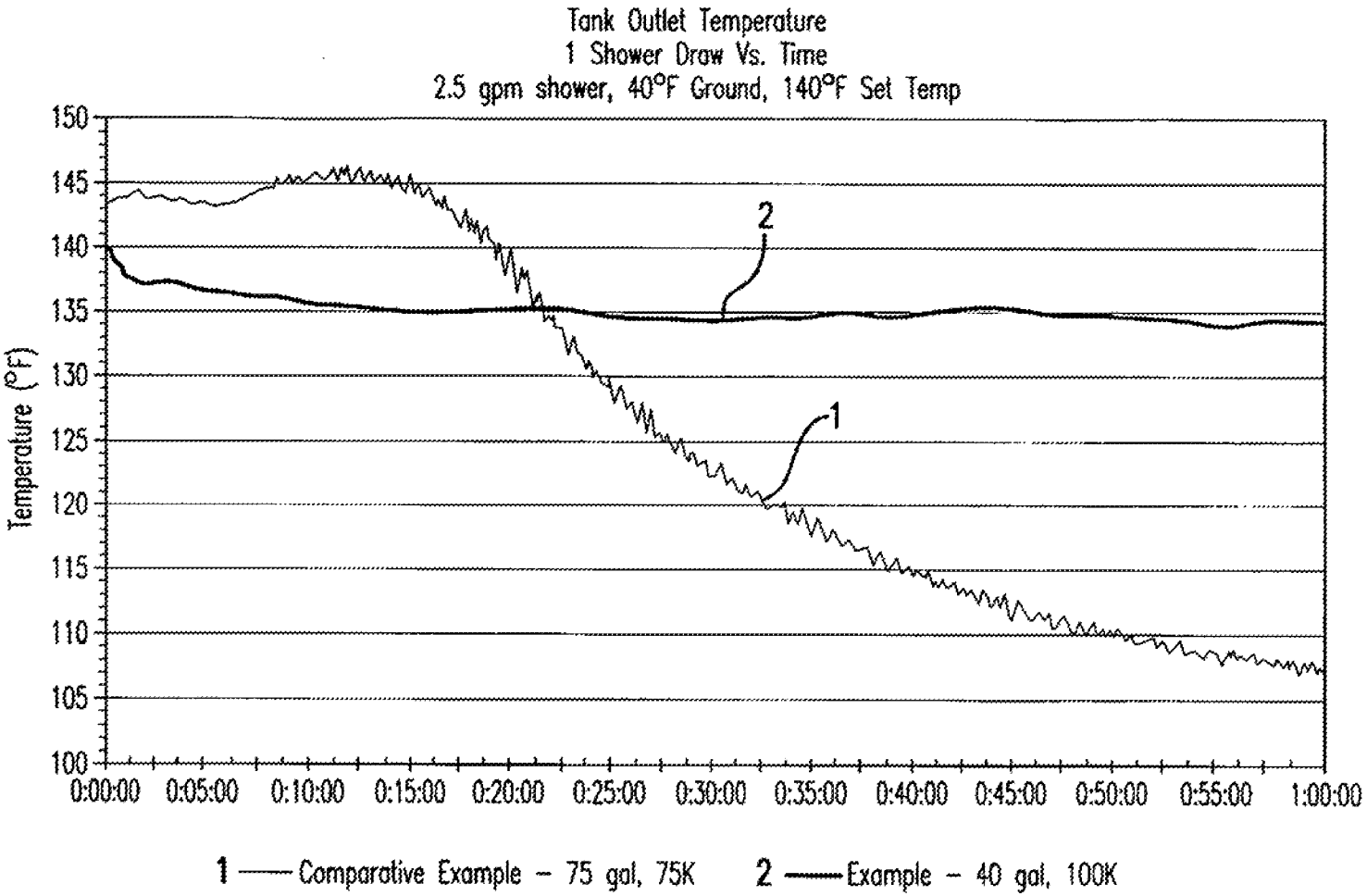
FIG. 17 is a graph of four comparative tests indicating temperature over time during a 2.5-gallon per minute draw.

FIG. 17 shows a comparative test of two water heaters. In FIG. 17, both units were subjected to a 2.5 gpm draw of water from the respective tanks. Lines 1 and 2 represent the water temperature exiting the tank. The flow rate of the shower or the mixed cold and hot water flow rate is 2.5 gpm. The water heater flow rate is calculated as approximately 1.7 gpm based on 140° F. water heater set temperature, 108° F. shower temperature, 40° F. ground water temperature according to the following formula: hot water flow rate=(mixed flow*(mixed temp−cold temp))/(hot temp−cold temp) (2.5 gpm*(108° F.−40° F.))/(140° F.−40° F.)=1.7 gpm of hot water. It can be seen from FIG. 17 that the water heater producing the results shown by line 2 was able to substantially maintain the 140° F. set temperature at about 135° F., while the conventional water heater produced the results shown by line 1 was able to maintain the set temperature for about 20-22 minutes, at which point it was unable to maintain the 140° F. set temperature.

Figure 18:
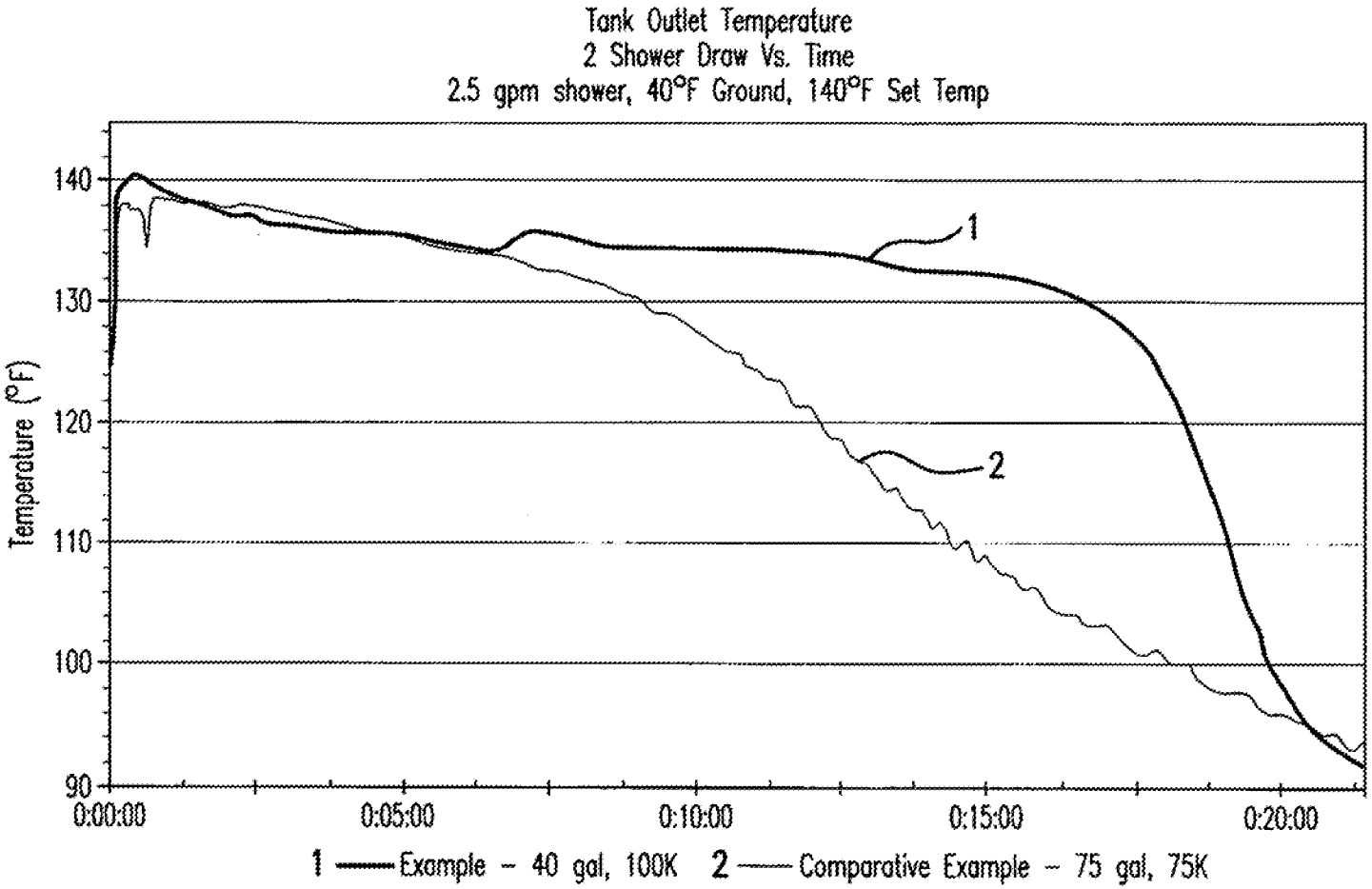
FIG. 18 is a graph of four comparative tests indicating temperature over time during two simultaneous 2.5-gallon per minute draws.

FIG. 18 is another comparison that is similar to the comparison of FIG. 17 except that the draw was doubled to a two-shower draw where upon substantially 5 gpm of water was drawn: (5.0 gpm*(108° F.−40° F.))/(140° F.−40° F.)=3.4 gpm of hot water. It can be seen the water heater as indicated by line 1 was substantially able to maintain close to the set temperature for about 16 minutes, while the conventional water heater as indicated by line 2 was able to substantially maintain the set temperature for about 7-8 minutes. Thus, our water heaters maintained the temperatures about 50% longer than the conventional water heaters.

Our experiments also demonstrate that there is a negligible amount of "stacking" that occurs in water containers 14 even in view of multiple draws of hot water. In particular, the experiments demonstrate that the temperature of heated water exiting the water container does not increase by more than about 10° F., preferably not by more than about 2° F., for a selected period of time such as, for example, fifteen minutes or more.

Thus, the water heater systems contemplated herein permit the controller to operate the burner unit to maintain the temperature of water in the water container substantially within a selected range for a selected time under the conditions where a selected amount of heated water is removed from the water container. It is possible that the temperature of the water in the water container is maintained above about 100° F. The selected range may be about 10° F. or even about 5° F. Also, the heated water should be maintained within the selected range for at least about fifteen minutes. However, it may be possible to maintain the temperature of the water within the selected range for about 30 minutes, about 60 minutes or substantially continuously for more than 60 minutes. The range of heated water drawn from the water container may be at least about 2.5 gpm or more such as about 5 gpm or more. It is also possible that the temperature of the heated water within the tank is maintained within a range of about 100° F. to about 110° F. or other ranges such as about 130° F. to about 140° F.

Although the apparatus and methods have been described in connection with specific forms thereof, it will be appreciated that a wide variety of equivalents may be substituted for the specified elements described herein without departing from the spirit and scope of this disclosure as described in the appended claims.

What is claimed is:

1. A water heating system comprising:

a water container having a top and bottom, a cold water inlet that connects to a water supply, a hot water outlet, a water heater outlet and a water heater inlet; an instantaneous water heater mounted to the water container and having a tank supply inlet connected to the water heater outlet, a tank supply outlet connected to the water heater inlet, a burner, and a heat exchanger located adjacent the burner between the tank supply inlet and the tank supply outlet; a dip tube connected to the cold water inlet and having an end that extends toward a lower portion the water container, a pump connected between the water container and the instantaneous water heater that moves water between the water container and the instantaneous water heater, and a controller that operates the pump and the burner said water container hot water inlet is located in the upper portion adjacent to the top and above the dip end, and wherein said water heater inlet includes a tube having a horizontally pointing opening such that water exiting the opening will create a horizontal swirling motion in the upper portion of the container, so that water in the upper portion will be heated more quickly by water from injected from the instantaneous water heater, thus prolonging the availability of hot water to a user.

2. The water heating system according to claim 1, wherein the instantaneous water heater is the only source of heat supplied to water in the water container.

3. The water heater system according to claim 2, wherein the instantaneous water heater further comprises a flammable vapor sensor connected to the controller and proximate a location where combustion air enters the burner.

4. The water heating system according to claim 1, wherein the tube is curved along a horizontal plane thereby enhancing the horizontal swirling.

5. The water heater system according to claim 1 wherein the tube is aligned horizontally in the container and the opening is pointing to and adjacent an inner wall of the container, so that horizontal water swirling is enhanced.

6. The water heater system according to claim 1, wherein the tube is located in the upper quartile of the distance between the top and bottom of the container.

7. The water heater system according to claim 1, wherein the instantaneous water heater further comprises a CO sensor connected to the controller and proximate a location where flue gases exit the burner.

8. The water heater system according to claim 1, wherein the water container further comprises a thermistor connected to the controller and positioned to sense temperature of water in the tank.

9. The water heating system according to claim 8, wherein the thermistor is positioned at a lower portion of the water container.

10. The water heater system according to claim 1, further comprising a thermistor connected to the controller and positioned between the water heater inlet and the heat exchanger.

11. The water heater system according to claim 1, wherein the burner is a burner whose heat output is adjusted by the controller in response to temperature of water entering the instantaneous water heater.

12. The water heating system according to claim 1 wherein the water heater inlet is located at an upper portion of the water container and shaped to direct heated water substantially horizontally circularly within the water container.

13. The method of heating water according to claim 12, further comprising, prior to igniting the burner: sensing flow of water moving from the water container to the instantaneous water heater.

14. A method of substantially maintaining a selected temperature of water in the water container of a water heating system having a water container having a cold water inlet that connects to a water supply, a hot water outlet, a water heater outlet and a water heater inlet; an instantaneous water heater, and having a tank supply inlet connected to the water heater outlet, a tank supply outlet connected to the water heater inlet; a pump connected between the water container and the instantaneous water heater that moves water between the water container and the instantaneous water heater, and a controller that operates the pump and the burner; the method comprising the steps of: sensing temperature of the water in the water container; comparing a sensed water temperature to a selected water set temperature; engaging the pump if the sensed water temperature is less than the selected water set temperature; and igniting the burner;

locating a hot water inlet tube the water container hot water in an upper portion of the container adjacent to the top thereof and above the dip tube end, placing the tube to have a horizontally pointing opening such that water exiting the opening will create a horizontal swirling motion in the upper portion of the container, so that water in the upper portion will be heated more quickly by water injected from the instantaneous water heater, thus prolonging the availability of hot water to a user.

15. The method of heating water according to claim 14, further comprising, prior to igniting the burner: sensing flow of water moving from the water container to the instantaneous water heater.

16. The method of heating water according to claim 14, further comprising, prior to engaging the pump: sensing presence of flammable vapors with a flammable vapors sensor and signaling the controller if a sensed concentration of flammable vapors exceeds a selected flammable vapors concentration; and engaging a combustion air fan proximate the burner if the sensed concentration of flammable vapors is below the selected flammable vapors concentration for a selected time period and signaling the controller if the sensed concentration of flammable vapors exceeds the selected flammable vapors concentration.

17. The method of heating water according to claim 14, further comprising adjusting the burner to provide varying amounts of heat to the heat exchanger in response to temperature of the water exiting the water container.

18. The method of heating water according to claim 14, further comprising, prior to engaging the pump: sensing presence of flammable vapors with a flammable vapors sensor and signaling the controller if a sensed concentration of flammable vapors exceeds a selected flammable vapors concentration; and engaging a combustion air fan proximate the burner if sensed concentration of flammable vapors is below the selected flammable vapors concentration for a selected time period and signaling the controller if the sensed concentration of flammable vapors exceeds the selected flammable vapors concentration.

* * * * *